US006192641B1

(12) United States Patent
Andraso et al.

(10) Patent No.: US 6,192,641 B1
(45) Date of Patent: Feb. 27, 2001

(54) EXPANSION JOINT FIRE BARRIER FOR WALLS

(76) Inventors: David Andraso; David Willke, both of 2362 Railroad St., Corona, CA (US) 91720

( * ) Notice: Subject to any disclaimer, the term of this patent is extended or adjusted under 35 U.S.C. 154(b) by 0 days.

(21) Appl. No.: 09/138,358

(22) Filed: Aug. 21, 1998

Related U.S. Application Data

(60) Provisional application No. 60/056,848, filed on Aug. 28, 1997.

(51) Int. Cl.[7] ..... E04B 1/68

(52) U.S. Cl. ..... 52/396.01; 52/396.04; 52/396.05; 52/396.08; 52/573; 52/235

(58) Field of Search ..... 52/396.01, 396.04, 52/396.05, 396.08, 402, 573.1, 586.1, 235, 404.5, 232

(56) References Cited

U.S. PATENT DOCUMENTS

| | | | | |
|---|---|---|---|---|
| 3,640,039 | * | 2/1972 | McKee et al. | 52/281 |
| 4,423,578 | * | 1/1984 | Meigs et al. | 52/396.04 |
| 4,566,242 | * | 1/1986 | Dunsworth | 52/396.01 |
| 4,662,142 | * | 5/1987 | Weiner | 248/638 |
| 4,825,617 | * | 5/1989 | Kinoshita et al. | 52/396.01 |
| 4,914,884 | * | 4/1990 | Ohmatsu | 52/396.05 |
| 5,197,250 | * | 3/1993 | Kramer | 52/396.04 |
| 5,228,255 | * | 7/1993 | Hahn | 52/396.04 |
| 5,335,466 | * | 8/1994 | Langohr | 52/396.04 |
| 5,694,730 | * | 12/1997 | Rincon et al. | 52/586.1 |
| 5,765,332 | * | 6/1998 | Landin et al. | 52/396.01 |
| 5,865,009 | * | 2/1999 | Jackson et al. | 52/745.2 |
| 5,868,399 | * | 2/1999 | Schluter | 277/650 |
| 5,875,598 | * | 3/1999 | Batten et al. | 52/396.01 |
| 5,887,308 | * | 3/1999 | Walter | 14/73.1 |

* cited by examiner

*Primary Examiner*—Christopher T. Kent
*Assistant Examiner*—Jennifer I. Thissell
(74) *Attorney, Agent, or Firm*—Robert D. Fish, Esq.; Fish & Associates, LLP

(57) ABSTRACT

Methods and apparatus for installing a fire rated insulation material to span an expansion joint between walls by hollowing out a portion of at least one wall adjacent to the joint to form at least one pocket, and installing the insulation material so that it spans the joint and can slide in and out of the at least one pocket.

5 Claims, 2 Drawing Sheets

EXPANSION JOINT FIRE BARRIER FOR WALLS

CLAIM TO PRIORITY

This application is entitled to and hereby claims priority to U.S. patent application Ser. No. 60/056,848, filed Aug. 28, 1997 said application being incorporated herein by reference.

FIELD OF THE INVENTION

The field of the invention is wall expansion joint fire barriers.

BACKGROUND OF THE INVENTION

Buildings are often constructed such that an expansion joint or other joint space exists between adjacent structures. Whether the space lies between adjacent buildings or adjacent portions of the same building, it is often necessary under local building codes, or otherwise desirable, to install a fire barrier which acts to prevent fire from traveling along the space. The design of such fire barriers can be complicated by several factors, including a relatively large potential cycling range, which commonly results from seismic movement (e.g., ground tremblings and earthquakes), settling and other actions.

It is known to drape a fire resistant blanket horizontally between adjacent floor sections such that relative movement normal to the joint will be accommodated by slack in the blanket. It is also known to provide sliding of the blanket or portions of the blanket relative to adjacent floor sections to accommodate relative movement axial to the joint. Examples of such blankets are described in U.S. Pat. No. 4,942,710, U.S. Pat. No. 5,032,447 and U.S. Pat. No. 5,140,797.

In some instances the contemplated potential normal movement can be quite large. Where there is sufficient vertical hanging space, and in joining adjacent floors, the extent of draping is not a serious problem because the blanket can be draped well below the level of the connections to the structures. In other instances there may be insufficient room to accommodate sufficient draping, and this problem presents itself especially with respect to adjacent walls, in which the insulation is disposed essentially vertically. In such circumstances, the "extra" portion of blanket must be contained within the wall itself. To date, there are no completely adequate solutions to this problem.

Thus there is a continuing need to develop methods and apparatus for installing fire barriers which act to prevent fire from traveling along expansion joints in walls.

SUMMARY OF THE INVENTION

Methods and apparatus are provided for installing a fire rated insulation material to span an expansion joint between walls by hollowing out a portion of at least one wall adjacent to the joint to form at least one pocket, and installing the insulation material so that it spans the joint and can slide in and out of the at least one pocket. Relative motion of the walls in a direction normal to the joint is accommodated by sliding of the insulation within the at least one pocket.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
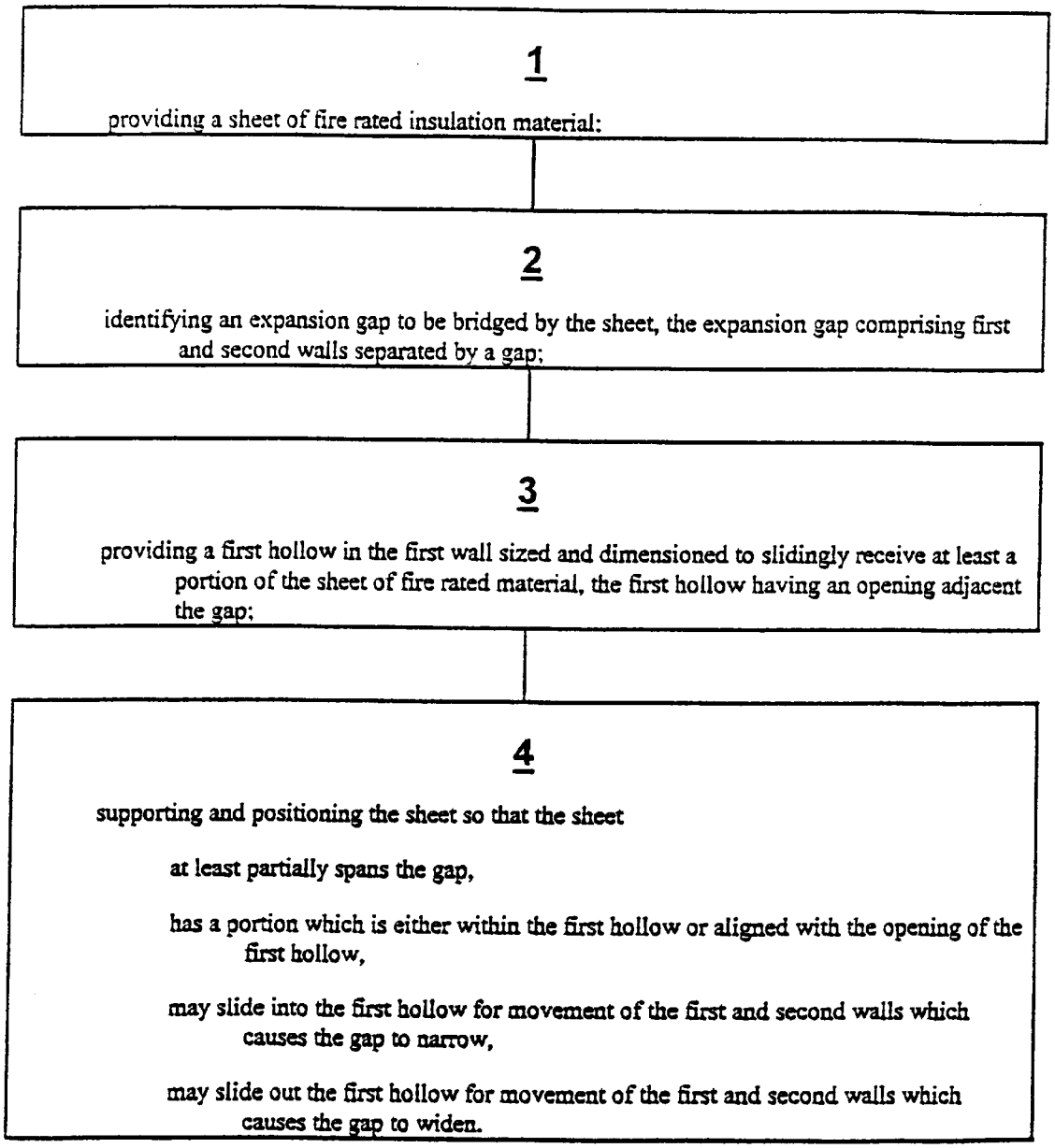
FIG. 1 is a schematic of a method embodying the claimed invention.

Referring to FIG. 1, a method embodying the claimed invention comprises (1) providing a sheet of fire rated insulation material; (2) identifying an expansion gap to be bridged by the sheet, the expansion gap comprising first and second walls separated by a gap; (3) providing a first hollow in the first wall sized and dimensioned to slidingly receive at least a portion of the sheet of fire rated material, the first hollow having an opening adjacent the gap; (4) supporting and positioning the sheet so that the sheet (a) at least partially spans the gap, (b) has a portion which is either within the first hollow or aligned with the opening of the first hollow, (c) may slide into the first hollow for movement of the first and second walls which causes the gap to narrow, (d) may slide out the first hollow for movement of the first and second walls which causes the gap to widen.

The term "slide into" as used herein is contemplated to include the situation in which no part of the insulation material is contained within the hollow and the insulation material enters the hollow while "sliding into" the hollow. The term "slide into" is also contemplated to include the situation in which a part of the insulation material is contained within the hollow and additional portions of the insulation material enter the hollow while the material "slides into" the hollow. Similarly, the term "slide out" includes the material sliding partially or completely out of the hollow.

The step of identifying an expansion gap may be accomplished prior to the actual construction of the gap. The step of providing a hollow may include either hollowing out a portion of an existing wall or may include including a hollow in the wall when it is built.

In other embodiments, the method of FIG. 1 may be modified to include additional steps and/or refine the existing steps. As an example, the step of supporting and positioning the sheet may further comprise attaching at least one turnbuckle or some other fastener between the sheet and the second wall. As another example, the method of claim 1 may further comprise providing a wiper coupled to the first wall so that the wiper at least partially bridges the gap between an edge of the opening and a side of the sheet. In yet another example, the step of providing a sheet of fire rated insulation material may include the steps of combining multiple layers of insulation material into a single, multi-layered sheet and/or reinforcing the sheet so as to minimize any tendency to buckle while the sheet is standing upright and to withstand the wall rubbing across its surface.

Figure 2:
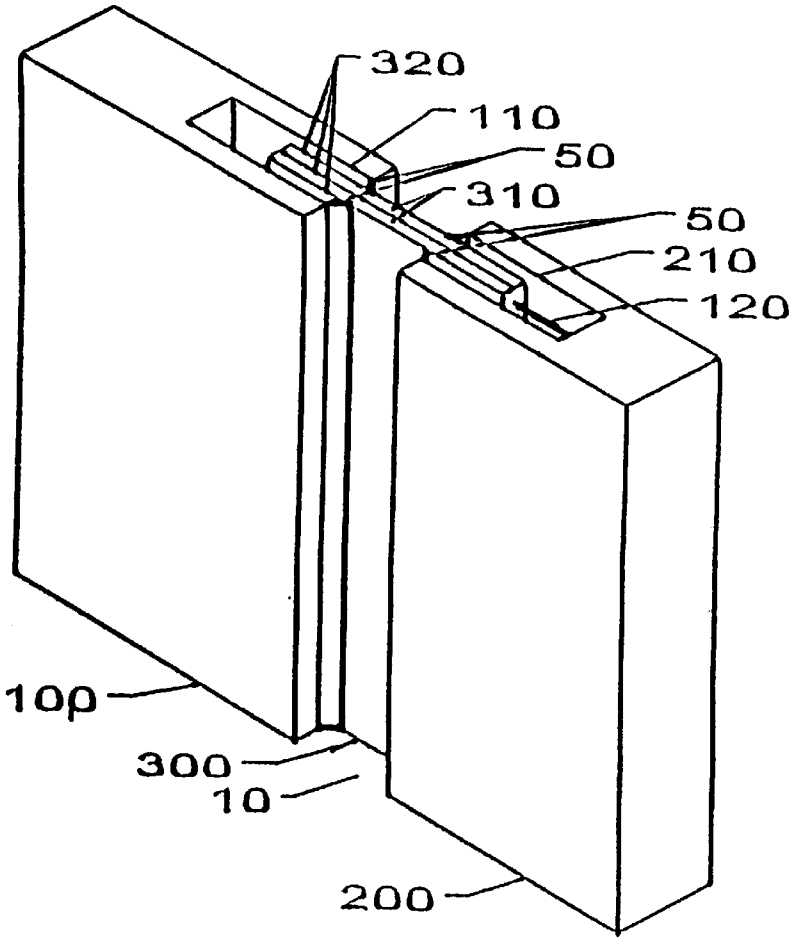
FIG. 2 is a perspective view of an installed fire barrier embodying the claimed invention.

In a preferred embodiment depicted in FIG. 2, adjacent walls 100 and 200 span a space 10. Wall 100 is hollowed out to form hollow/pocket 110 and wall 200 is hollowed out to form hollow/pocket 210. A relatively stiff, fire-rated sheet of insulation 300 is then positioned across the space 10 and through the pockets 110, 210, and affixed to wall 100 with turnbuckle 120. Also depicted in FIG. 2 are four wipers 50 which act to prevent foreign material from penetrating into and out of the wall pockets 110 and 210, and to block direct flame penetration into the walls 100, 200 during a fire. As shown in FIG. 2, this configuration allows the insulation 300 to slide back on forth within pocket 210 as the walls 100 and 200 move relative to each other in a manner which causes gap 10 to widen or narrow.

The insulation sheet 300 is seen to comprise multiple layers of insulation 310 and backing 320. The insulation 310 can be chosen form any number of suitable insulator materials, including fiberglass and the like, and is not limited herein to flexible or non-flexible materials. The backing 320 can likewise comprise any suitable material, with preferred materials contemplated to include stainless steel or foil. In particularly preferred embodiments, backing 320 is contemplated to be thicker than that normally associated with insulation blankets, because the insulation here must stand upright without significant buckling and must withstand the wall rubbing across its surface. Of course, the insulation sheet may contain a greater or fewer number of layers than that shown in FIG. 3, and may, for example, include only a single layer of sufficiently stiff, and sufficiently fire rated material.

Wipers 50 may be fire resistant to prevent fame penetration into the hollows 10 and 210 or may not be fire resistant and simply function to prevent debris from entering the hollows. Although wipers 50 may be made from any suitable material it is preferred that wipers 50 be made from silicone coated fabric and ceramic fiber insulation. Although FIG. 2 depicts four wipers having a particular configuration, other numbers and configuration may also be incorporated. Similarly, the sizes and dimensions of any wipers used may vary and my be at least partially dependent on materials and/or manner of use.

Thus, specific embodiments and applications of expansion joint fire barriers for walls have been disclosed. It should be apparent, however, to those skilled in the art that many more modifications besides those already described are possible without departing from the inventive concepts herein. For example, it is contemplated to provide a hollowed area (pocket) in only one of the walls, and to attach the insulation sheet directly to the unhollowed wall adjacent the joint. In that case all of the movement of the walls relative to each other would be accommodated by movement of the insulation sheet inside the single pocket. This could be accomplished in many ways, such as replacing the turnbuckle 120 of FIG. 1 with a spring or other biasing member. Similarly, both adjacent walls could be hollowed out, with the insulation sheet being attached to biasing members within each of the respective pockets. The inventive subject matter, therefore, is not to be restricted except in the spirit of the appended claims.

What is claimed is:

1. A method for constructing an expansion joint fire barrier for walls comprising the following steps:

providing a sheet of fire rated insulation material, the insulation material comprising a backing and an insulation;

wherein at least one of the backing and insulation has a sufficient thickness to prevent significant buckling of the insulation material when standing upright;

identifying an expansion gap to be bridged by the sheet, the expansion gap comprising first and second walls separated by a gap;

providing a first hollow in the first wall sized and dimensioned to slidingly receive at least a portion of the sheet of fire rated material, the first hollow having an opening adjacent the gap;

supporting and positioning the sheet with at least one biasing element so that the sheet at least partially spans the gap, has a portion which is either within the first hollow or aligned with the opening of the first hollow, may slide into the first hollow for movement of the first and second walls which causes the gap to narrow, may slide out the first hollow for movement of the first and second walls which causes the gap to widen.

2. The method of claim 1 wherein the step of supporting and positioning the sheet with at least one biasing element further comprises attaching a turnbuckle between the sheet and the second wall.

3. The method of claim 1 wherein the step of supporting and positioning the sheet with at least one biasing element further comprises attaching a biasing member between the sheet and one of the first and second walls.

4. The method of claim 1 further comprising providing a wiper coupled to the first wall so that the wiper at least partially bridges the gap between an edge of the opening and a side of the sheet.

5. The method of claim 1 further comprising providing a hollow in the second wall sized and dimensioned to slidingly receive at least a portion of the sheet of fire rated material, the hollow having on opening adjacent the gap, supporting and positioning the sheet so that it also has a portion which is either within the second hollow or aligned with the opening of the second hollow, may slide into the second hollow for movement of the first and second walls which causes the gap to narrow, may slide out the second hollow for movement of the first and second walls which causes the gap to widen.

* * * * *